US010559290B2

(12) United States Patent
Sato et al.

(10) Patent No.: US 10,559,290 B2
(45) Date of Patent: Feb. 11, 2020

(54) ELECTRONIC MUSICAL INSTRUMENT, METHOD, AND STORAGE MEDIUM

(71) Applicant: CASIO COMPUTER CO., LTD., Tokyo (JP)

(72) Inventors: Hiroki Sato, Tokyo (JP); Hajime Kawashima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/359,567

(22) Filed: Mar. 20, 2019

(65) Prior Publication Data

US 2019/0295517 A1 Sep. 26, 2019

(30) Foreign Application Priority Data

Mar. 22, 2018 (JP) ..... 2018-054636

(51) Int. Cl.

| | |
|---|---|
| ***G10H 7/00*** | (2006.01) |
| ***G10H 1/00*** | (2006.01) |
| ***G10H 1/24*** | (2006.01) |
| ***G10H 7/02*** | (2006.01) |

(52) U.S. Cl.

CPC ..... *G10H 1/0033* (2013.01); *G10H 1/24* (2013.01); *G10H 7/02* (2013.01); *G10H 2240/311* (2013.01)

(58) Field of Classification Search

CPC ..... G10H 1/0033; G10H 1/24; G10H 7/02; G10H 2240/311

USPC ..... 84/602, 603

See application file for complete search history.

(56) References Cited

U.S. PATENT DOCUMENTS

| | | | | |
|---|---|---|---|---|
| 5,892,170 | A * | 4/1999 | Ichiki | G10H 7/002 84/605 |
| 5,949,011 | A * | 9/1999 | Ichiki | G10H 7/002 84/602 |
| 6,111,182 | A * | 8/2000 | Takahashi | G10H 7/002 84/609 |
| 10,373,595 | B2 * | 8/2019 | Sato | G10H 1/0008 |
| 2002/0139238 | A1 * | 10/2002 | Mukaino | G10H 1/0075 84/622 |

(Continued)

FOREIGN PATENT DOCUMENTS

| | | | |
|---|---|---|---|
| JP | H4-168491 | A | 6/1992 |
| JP | H4-288596 | A | 10/1992 |

(Continued)

*Primary Examiner* — Jeffrey Donels

(74) *Attorney, Agent, or Firm* — Chen Yoshimura LLP

(57) ABSTRACT

An electronic musical instrument includes a sound source LSI to generate a musical sound using a RAM that retains waveform data that has been selectively read from a plurality of waveforms stored in a large-capacity flash memory, and smoothly executes transfer of additional waveform data from the flash memory to the RAM when the requisite waveform data is not retained in the RAM during the performance. Performance data is generated by a sequencer, a prescribed delay time is applied to the performance data by an event time generator and an event delay buffer so as to provide for sufficient time for the transfer of the additional waveform if such transfer is needed. A musical sound is generated by an event buffer and a sound source driver on the basis of the delayed performance data.

7 Claims, 18 Drawing Sheets

(56) References Cited

U.S. PATENT DOCUMENTS

| | | | | |
|---|---|---|---|---|
| 2007/0119289 | A1* | 5/2007 | Hirano | G10H 7/004 84/603 |
| 2010/0147138 | A1* | 6/2010 | Chamberlin | G10H 7/02 84/603 |
| 2018/0277073 | A1* | 9/2018 | Sato | G10H 1/24 |
| 2018/0277074 | A1* | 9/2018 | Sato | G10H 1/183 |
| 2019/0034115 | A1* | 1/2019 | Sato | G06F 3/0604 |

FOREIGN PATENT DOCUMENTS

| | | | |
|---|---|---|---|
| JP | H6-27943 | A | 2/1994 |
| JP | H6-266354 | A | 9/1994 |
| JP | 2000-276149 | A | 10/2000 |

* cited by examiner

| Buffer number | Transfer completion flag | Tone color number | Tone color waveform number | Waveform size |
|---|---|---|---|---|
| 0 | 1 | 3 | 8 | 8C50H |
| 1 | 1 | 2 | 12 | 8908H |
| 2 | 1 | 3 | 10 | 6384H |
| 3 | 1 | 5 | 11 | 7890H |
| 4 | 0 | 0 | 0 | 0 |
| ⋮ | ⋮ | ⋮ | ⋮ | ⋮ |
| 255 | 0 | 0 | 0 | 0 |

FIG. 7

| Field name | L (LENGTH) | E (EVENT) | I (INTERVAL) |
|---|---|---|---|
| Content | Event data length | Event | Interval |
| Word length | 8bit | 1 to 256 bytes | 16bit |
| Value range | 0-255 | Control event: data sequence that starts with 00H-7FH, MIDI event: data sequence that starts with 90H-FFH | 0-65535 |
| Remarks | Value of data length minus 1 | For detailed specifications of control events, refer to "formats of control events" in FIG. 10, MIDI events are data based on the MIDI format | Time interval to next event expressed in tick units (=1/480 beats) |

FIG. 8

| Event name | Event data length | Format | Content |
|---|---|---|---|
| NOP | 1 | 00H | Used as dummy event when head of track or interval time exceeds 65535 ticks |
| EOT (END OF TRACK) | 1 | 01H | Arranged at end of track |
| TEMPO | 3 | 02H, m, l | Function: tempo setting<br>Limitation: recognized only in track 1<br>Resolution: 0.1 BPM units<br>Calculation formula: Tempo = (m*256+1)/10 BPM<br>Example: m = 04H, l = B5H at 120.5 BPM |

FIG. 10

| Event data length 1 | Event content | Event value | Interval |
|---|---|---|---|
| 2 | TEMPO | 02H, 78H, 00H | T1 |
| 2 | NOTE ON<br>Ch=1, K=C4, V=100 | 90H, 3CH, 64H | T2 |
| 2 | NOTE OFF<br>Ch=1, K=C4, V=64 | 80H, 3CH, 40H | T3 |
| ⋮ | ⋮ | ⋮ | ⋮ |
| 2 | PITCH BEND<br>Ch=1, Pb=0 | E0H, 00H, 40H | Tn |
| 0 | EOT<br>(End Of Track) | EOT<br>(End Of Track) | 0 |

| Field name | T (TIME) | L (LENGTH) | E (EVENT) |
|---|---|---|---|
| Content | Time | Event data length | Event |
| Word length | 32bit | 8bit | 1 to 256 bytes |
| Value range | 0-FFFFFFFFH | Similar to sequencer event data | Similar to sequencer event data |
| Remarks | Time point at which this event is to be processed | Value of data length minus 1 | Similar to sequencer event data |

FIG. 12

ELECTRONIC MUSICAL INSTRUMENT, METHOD, AND STORAGE MEDIUM

BACKGROUND OF THE INVENTION

Technical Field

The present invention relates to an electronic musical instrument, a method, and a storage medium.

Background Art

In automatic performance devices that use an electronic keyboard instrument or the like, technology has been proposed for improving the response at the time of a key-on, and efficiently carrying out tone color assignment for musical sound information at the time of an automatic performance, without increasing the capacity of a waveform buffer (Patent Document 1, for example).

Generally, in electronic musical instruments including the technology described in the aforementioned patent document, to be able to use greater kinds of waveform data as well as longer duration waveform data, a system configuration is adopted in which unused waveform data is stored in a secondary storage device that is a large-capacity auxiliary storage device such as a flash memory or a hard disk device, and only waveform data that is actually used in a performance is transferred and retained in a primary storage device that is a waveform memory accessible by a sound source circuit, and a desired musical sound is played.

In this case, it is possible to realize an efficient technique having excellent cost performance, obtained by combining an expensive waveform memory that constitutes the primary storage device, and a comparatively cheap secondary storage device that cannot be directly accessed from a sound source circuit but has a larger capacity.

Patent Document 1: Japanese Patent Application Laid-Open Publication No. H6-27943

However, in the aforementioned technique, a certain time is required to transfer waveform data from the secondary storage device to the primary storage device. Therefore, even if the tone color is the same, in a case such as where a plurality of waveforms are used and switched in accordance with the key range and key stroke intensity, processing to transfer the waveform at an appropriate time during the performance is required, and sounds based on that waveform cannot be generated until the transfer has been completed, which therefore disrupts the performance.

Particularly in electronic musical instruments that include an automatic performance function such as a sequencer or an automatic accompaniment, for sound sources of a plurality of parts to be generated at the same time, there are many cases where a large amount of sound generation processing is carried out in a short period of time in accordance with the performance of a performer, and there is a possibility of a situation occurring where the generation of some sounds is interrupted by the transfer of waveform data as mentioned above.

Furthermore, similar to a communication karaoke system, a method has also been realized in which all required waveforms (i.e., data thereof) are transferred and stored in a waveform memory at the point in time at which an automatic performance musical piece is selected. However, in recent sound sources and automatic performance systems, there is a large number of parts and there is also a high number of tone colors used within a selected musical piece, and therefore it is necessary to transfer waveform data of a large number of tone colors to a waveform memory in advance.

Furthermore, there are also many cases where only some of a plurality of waveforms constituting one tone color is actually used in a performance, and the time required for transfer and the waveform memory capacity are both wasted in such cases. In this way, a scheme for transferring all waveform data that may be required when a musical piece is selected is deficient in that it is extremely inefficient in terms of time and memory capacity.

The present invention has been devised in light of the aforementioned circumstances, and has an advantage in smoothly executing processing for when waveform data is to be additionally transferred and retained in a case where waveform data other than the waveform data that has been retained for sound source purposes is required.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument including: a plurality of playing keys to be operated by a user for generating a real time sound generation event to be outputted from the musical instrument in real time; a first memory that stores a plurality of waveforms to be used in automatic performance that is outputted by the musical instrument in accordance with automatic performance data so as to accompany the real time sound generation event; a second memory having faster access speed than the first memory, the second memory including an event buffer for storing data for the real time sound generation event specified by the user operation of the playing keys and data for the automatic performance, the second memory further including a plurality of waveform buffers for retaining data for waveforms to be used in sound production; and at least one processor, wherein the at least one processor performs the following: causing the automatic performance data to be generated, the automatic performance data including an identifier to specify a waveform used in the automatic performance, data that specifies events included in the automatic performance, and data that indicates a playback timing of each of the events in the automatic performance; searching the plurality of waveform buffers in the second memory to determine whether any of the plurality of waveform buffers retains the waveform specified by the identifier in the automatic performance data; if the searching determines that none of the plurality of waveform buffers retain the specified waveform, accessing the first memory, retrieving the specified waveform from the first memory, and causing the specified waveform to be retained in one of the plurality of waveform buffers in the second memory that is available or is caused to be available; causing the playback timing of each of the events in the automatic performance data to be delayed by a prescribed delay time to generate delayed automatic performance data that include the events with the delayed playback timings, and causing the delayed automatic performance data to be stored in the event buffer, the prescribed delay time being such that the transfer and retention of the specific waveform from the first memory to the second memory are completed during the prescribed delay time; and accessing the event buffer to retrieve the data for the real time sound generation event and the delayed automatic performance data and causing a sound corresponding to the user operation of the playing keys and a sound of the automatic performance to be generated and outputted from the musical instrument in accordance with the retrieved data for the real time sound generation event and the retrieved delayed automatic performance data.

In another aspect, the present disclosure provides a method of sound generation performed by an electronic musical instrument that includes: a plurality of playing keys to be operated by a user for generating a real time sound generation event to be outputted from the musical instrument in real time; a first memory that stores a plurality of waveforms to be used in automatic performance that is outputted by the musical instrument in accordance with automatic performance data so as to accompany the real time sound generation event; a second memory having faster access speed than the first memory, the second memory including an event buffer for storing data for the real time sound generation event specified by the user operation of the playing keys and data for the automatic performance, the second memory further including a plurality of waveform buffers for retaining data for waveforms to be used in sound production; and at least one processor, the method including via the at least one processor: causing the automatic performance data to be generated, the automatic performance data including an identifier to specify a waveform used in the automatic performance, data that specifies events included in the automatic performance, and data that indicates a playback timing of each of the events in the automatic performance; searching the plurality of waveform buffers in the second memory to determine whether any of the plurality of waveform buffers retains the waveform specified by the identifier in the automatic performance data; if the searching determines that none of the plurality of waveform buffers retain the specified waveform, accessing the first memory, retrieving the specified waveform from the first memory, and causing the specified waveform to be retained in one of the plurality of waveform buffers in the second memory that is available or is caused to be available; causing the playback timing of each of the events in the automatic performance data to be delayed by a prescribed delay time to generate delayed automatic performance data that include the events with the delayed playback timings, and causing the delayed automatic performance data to be stored in the event buffer, the prescribed delay time being such that the transfer and retention of the specific waveform from the first memory to the second memory are completed during the prescribed delay time; and accessing the event buffer to retrieve the data for the real time sound generation event and the delayed automatic performance data and causing a sound corresponding to the user operation of the playing keys and a sound of the automatic performance to be generated and outputted from the musical instrument in accordance with the retrieved data for the real time sound generation event and the retrieved delayed automatic performance data.

In another aspect, the present disclosure provides a non-transitory computer-readable storage medium having stored thereon including a program executable by at least processor contained in for causing an electronic musical instrument to execute, the electronic musical instrument further including: a plurality of playing keys to be operated by a user for generating a real time sound generation event to be outputted from the musical instrument in real time; a first memory that stores a plurality of waveforms to be used in automatic performance that is outputted by the musical instrument in accordance with automatic performance data so as to accompany the real time sound generation event; and a second memory having faster access speed than the first memory, the second memory including an event buffer for storing data for the real time sound generation event specified by the user operation of the playing keys and data for the automatic performance, the second memory further including a plurality of waveform buffers for retaining data for waveforms to be used in sound production, the program causing the at least one processor to perform: causing the automatic performance data to be generated, the automatic performance data including an identifier to specify a waveform used in the automatic performance, data that specifies events included in the automatic performance, and data that indicates a playback timing of each of the events in the automatic performance; searching the plurality of waveform buffers in the second memory to determine whether any of the plurality of waveform buffers retains the waveform specified by the identifier in the automatic performance data; if the searching determines that none of the plurality of waveform buffers retain the specified waveform, accessing the first memory, retrieving the specified waveform from the first memory, and causing the specified waveform to be retained in one of the plurality of waveform buffers in the second memory that is available or is caused to be available; causing the playback timing of each of the events in the automatic performance data to be delayed by a prescribed delay time to generate delayed automatic performance data that include the events with the delayed playback timings, and causing the delayed automatic performance data to be stored in the event buffer, the prescribed delay time being such that the transfer and retention of the specific waveform from the first memory to the second memory are completed during the prescribed delay time; and accessing the event buffer to retrieve the data for the real time sound generation event and the delayed automatic performance data and causing a sound corresponding to the user operation of the playing keys and a sound of the automatic performance to be generated and outputted from the musical instrument in accordance with the retrieved data for the real time sound generation event and the retrieved delayed automatic performance data.

It is to be understood that both the foregoing general description and the following detailed description are exemplary and explanatory, and are intended to provide further explanation of the invention as claimed.

BRIEF DESCRIPTION OF THE DRAWINGS

A deeper understanding of the present application will be gained with reference to the detailed descriptions below together with the following drawings.

FIG. 7 is a drawing depicting a directory configuration for data retained in waveform buffers for waveform generation units according to the same embodiment.

FIG. 8 is a drawing depicting the format configuration of sequence data recorded in a sequencer according to the same embodiment.

FIG. 10 is a drawing depicting the data formats of control events according to the same embodiment.

FIG. 12 is a drawing depicting the format configuration of data handled by an event delay buffer according to the same embodiment.

DETAILED DESCRIPTION OF EMBODIMENTS

An embodiment in a case where the present invention is applied to an electronic keyboard instrument having an automatic accompaniment function will hereinafter be described in detail with reference to the drawings.

Figure 1:
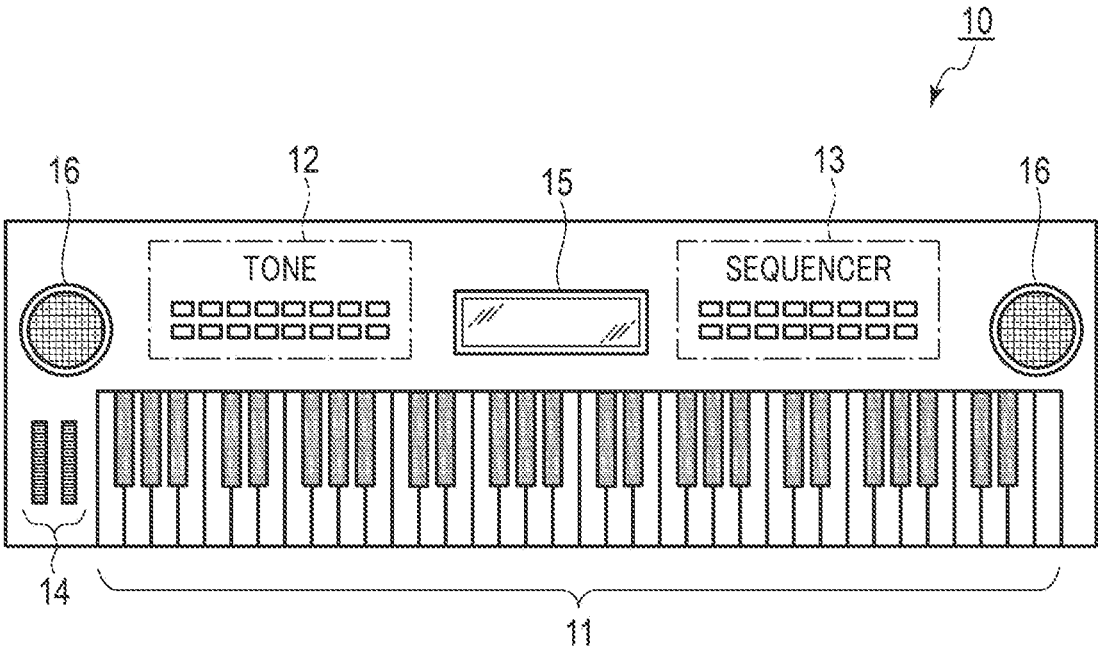
FIG. 1 is a plan view depicting the external appearance of an electronic keyboard instrument according to an embodiment of the present invention.

FIG. 1 is a plan view depicting the external appearance of an electronic keyboard instrument 10. In the same drawing, the electronic keyboard instrument 10 is provided with, on the upper surface of a thin plate-shaped housing: a keyboard 11 composed of a plurality of playing keys, which specify the pitch of musical sounds to be played; a tone color selection button unit (TONE) 12 for selecting the tone color of musical sounds; a sequencer operation button unit (SEQUENCER) 13 for various types of selection settings relating to an automatic accompaniment function; bender/modulation wheels 14 that add various types of modulation (performance effects) such as pitch bend, tremolo, and vibrato; a liquid crystal display unit 15 that displays various types of setting information; left and right speakers 16 and 16 that emit musical sounds generated by a performance; and the like.

The tone color selection button unit 12 has selection buttons for a piano, an electric piano, an organ, electric guitars 1 and 2, an acoustic guitar, a saxophone, strings, synthesizers 1 and 2, a clarinet, a vibraphone, an accordion, a bass, a trumpet, a choir, and the like.

The sequencer operation button unit 13 has selection buttons such as "Track 1" to "Track 4" for selecting a track, "Song 1" to "Song 4" for selecting a song memory, pause, play, record, return to start, rewind, fast forward, tempo down, and tempo up.

The sound source for this electronic keyboard instrument 10 adopts the PCM (pulse-code modulation) waveform generation scheme, and is capable of generating a maximum of 256 sounds. Furthermore, it is possible to have five sound source parts having sound source part numbers "0" to "4", and to play 16 types of tone colors at the same time. The sound source part number "0" is assigned to the keyboard 11, whereas the sound source part numbers "1" to "4" are assigned to sequencer functions.

Furthermore, this electronic keyboard instrument 10 is mounted with 16 melody tone colors, and "1" to "16" are assigned for the respective tone color numbers.

Figure 2:
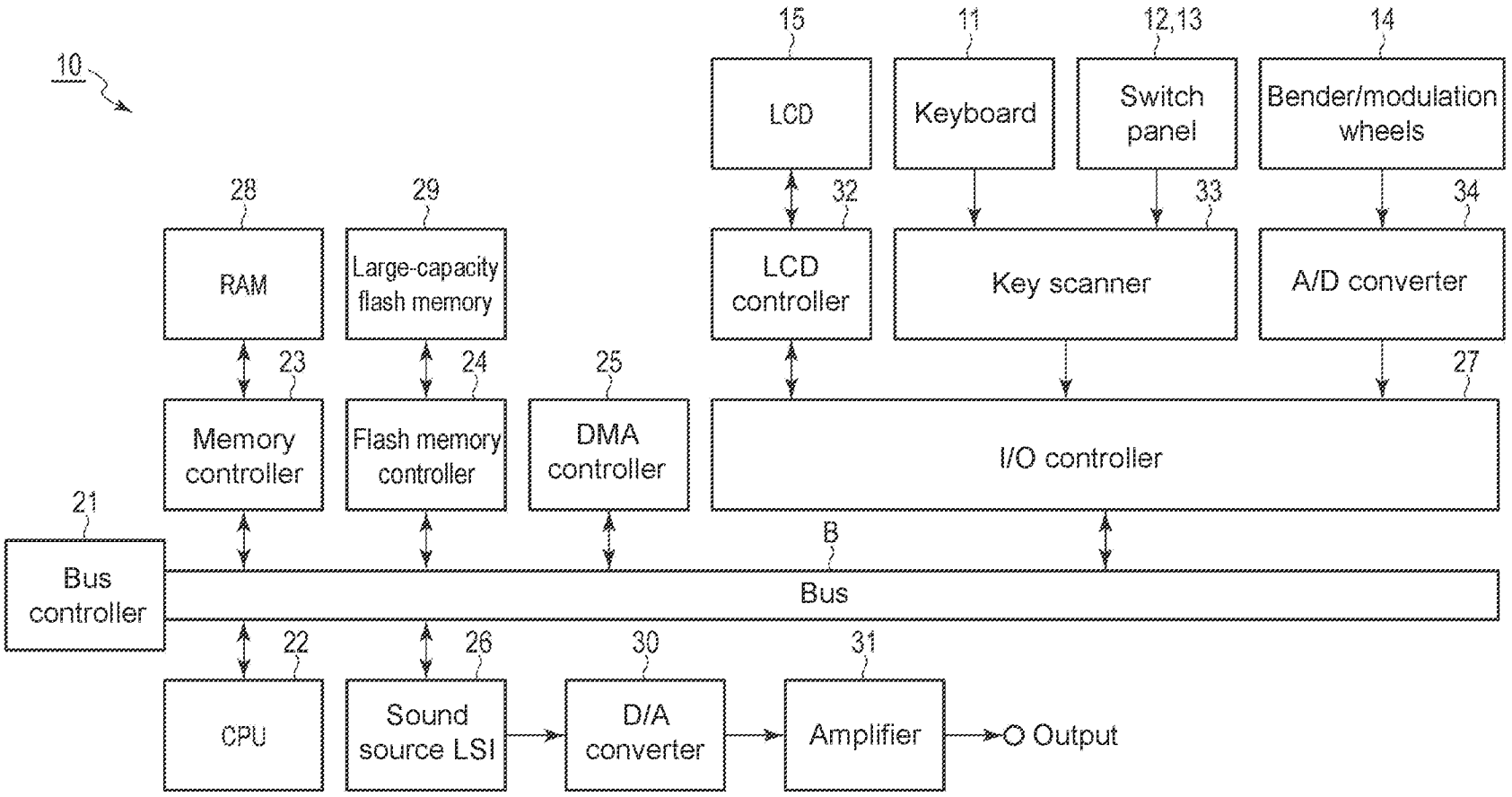
FIG. 2 is a block diagram depicting a circuit configuration in terms of hardware according to the same embodiment.

FIG. 2 is a block diagram depicting the circuit configuration in terms of hardware. In the electronic keyboard instrument 10, a bus controller 21 is connected to a bus B and controls the flow of data transmitted and received in this bus B according to preset priority rankings.

A CPU (central processing unit) 22, a memory controller 23, a flash memory controller 24, a DMA (direct memory access) controller 25, a sound source LSI (large-scale integrated circuit) 26, and an input/output (I/O) controller 27 are each connected to the bus B.

The CPU 22 is a main processor that carries out processing for the entire device. The memory controller 23 connects a RAM 28 constituted by an SRAM (static RAM), for example, and transmits and receives data with the CPU 22. The RAM 28 functions as a work memory for the CPU 22, and retains waveform data (including automatic performance waveform data) and control programs, data, and the like as necessary.

The flash memory controller 24 connects a large-capacity flash memory 29 constituted by a NAND flash memory, for example, and, according to requests issued by the CPU 22, reads control programs, waveform data, fixed data, and the like stored in the large-capacity flash memory 29. The various types of read data and the like are retained in the RAM 28 by the memory controller 23. The memory region for the large-capacity flash memory 29 can also be extended by means of a memory card mounted in the electronic keyboard instrument 10 in addition to a flash memory built in the electronic keyboard instrument 10.

The DMA controller 25 is a controller that controls the transmitting and receiving of data between peripheral devices described hereinafter and the RAM 28 and large-capacity flash memory 29 without using the CPU 22.

The sound source LSI 26 generates digital musical sound generation data using a plurality waveforms data retained in the RAM 28, and outputs the musical sound generation data to a D/A converter 30.

The D/A converter 30 converts the digital musical sound generation data into an analog musical sound production signal. The analog musical sound production signal obtained by the conversion is further amplified by an amplifier 31, and is then audibly output as a musical sound in an audible frequency range by the speakers 16 and 16 or output via an output terminal that is not depicted in FIG. 1.

The input/output controller 27 implements an interface with devices peripherally connected to the bus B, and connects an LCD controller 32, a key scanner 33, and an A/D converter 34.

The LCD controller 32 connects the liquid crystal display unit (LCD) 15 of FIG. 1, and displays and outputs information indicating various types of imparted operating states or the like by means of the liquid crystal display unit 15 under the control of the CPU 22 via the input/output controller 27 and the bus B.

The key scanner 33 scans key operation states in the keyboard 11 and a switch panel including the tone color selection button unit 12 and the sequencer operation button unit 13, and notifies scan results to the CPU 22 via the input/output controller 27.

The A/D converter 34 receives analog signals indicating operation positions of the bender/modulation wheels 14 and a damper pedal or the like constituting external optional equipment of the electronic keyboard instrument 10, and converts the operation amounts into digital data and notifies the CPU 22 thereof.

Figure 3:
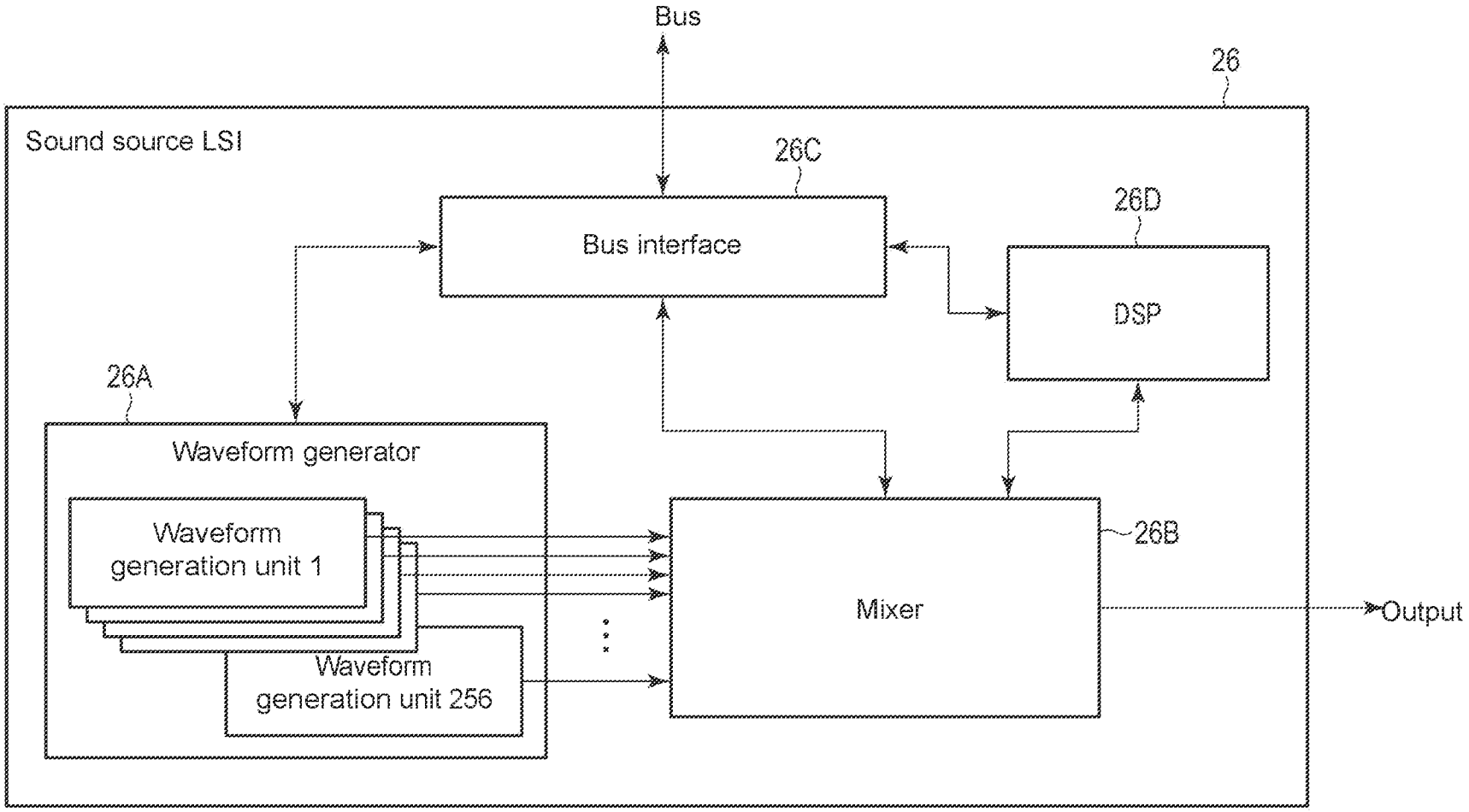
FIG. 3 is a block diagram depicting the functional configuration within the sound source LSI of FIG. 2 according to the same embodiment.

FIG. 3 is a block diagram depicting the functional configuration within the sound source LSI 26. As depicted in the same drawing, the sound source LSI 26 has a waveform generator 26A, a mixer 26B, a bus interface 26C, and a DSP (digital signal processor) 26D.

The waveform generator 26A has 256 sets of waveform generation units 1 to 256 that respectively generate musical sounds on the basis of waveform data provided from the RAM 28 via the bus interface 26C, and digital-value musical sound generation data that has been output is sent to the mixer 26B.

The mixer 26B mixes musical sound generation data that is output from the waveform generator 26A, sends the mixed musical sound generation data to the sound source LSI 26 to have audio processing executed thereon as necessary, receives post-execution data from the DSP 26D, and outputs this data to the subsequent D/A converter 30.

The bus interface 26C is an interface that carries out input/output control for the waveform generator 26A, the mixer 26B, and the bus interface 26C via the bus B.

The DSP 26D reads musical sound generation data from the sound source LSI 26 and applies audio processing thereto on the basis of an instruction provided from the CPU 22 via the bus interface 26C, and then sends the musical sound generation data back to the mixer 26B.

Next, a block diagram depicting a functional configuration in terms of processing executed under the control of the CPU 22 will be described using FIG. 4.

In this drawing, an operation signal corresponding to a tone color selection operation at the tone color selection button unit 12 by the performer of the electronic keyboard instrument 10, an on/off signal of note information that accompanies an operation at the keyboard 11, and an operation signal produced by an operation at the bender/modulation wheels 14 or the optional damper pedal are input to a sequencer 42 and an event buffer 45.

Furthermore, an operation signal from the sequencer operation button unit 13 and automatic performance data from a song memory 41 are input to the sequencer 42. The song memory 41 is actually constructed within the large-capacity flash memory 29, and is a memory capable of storing automatic performance data of a plurality of musical pieces, four musical pieces for example, and, during playback, causes the automatic performance data of one musical piece selected by means of the sequencer operation button unit 13 to be retained in the RAM 28 and thereby read out to the sequencer 42.

The sequencer 42 is a configuration having four tracks ("Track 1" to "Track 4") as depicted, and is able to carry out a performance or recording using the automatic performance data of the one musical piece selected and read from the song memory 41.

During recording, it is possible for any recording target track to be selected to record a performance by the performer. Furthermore, during playback, the four tracks are synchronized and performance data to be output is output in a mixed state. The performer who uses the electronic keyboard instrument 10 presses the necessary buttons in the sequencer operation button unit 13 to thereby select and instruct the operations thereof.

Performance data of a maximum of four tracks output from the sequencer 42 is sent to an event delay buffer 44 and a required waveform investigation unit 46.

The event delay buffer 44 is constituted by a ring buffer formed in a work region of the RAM 28 of FIG. 2, and sends performance data received from the sequencer 42 to the event buffer 45 after a delay of a preset fixed time, 50 milliseconds for example, on the basis of present time point information T provided from an event time generator 43. Therefore, a capacity is ensured with which the event delay buffer 44 is only able to retain events that can be generated in the fixed time.

The required waveform investigation unit 46 is formed in the work region of the RAM 28 of FIG. 2, determines waveform data that is newly required on the basis of: performance data sent from the sequencer 42 (an identifier composed of a tone color number, a key number, and velocity information is included in this performance data, and a required waveform can be investigated by referring to this identifier); information on sound generation event sent from a sound source driver 48 described hereinafter; and information of waveform data retained in the RAM 28 at that point in time, and outputs the determination result to a waveform transfer unit 47. The waveform transfer unit 47 causes waveform data instructed from the waveform transfer unit 47 to be read from the large-capacity flash memory 29 and transferred to the RAM 28 where it is retained.

The event buffer 45 is formed in the work region of the RAM 28 of FIG. 2, retains operation signals sent from the keyboard 11, the tone color selection button unit 12, the bender/modulation wheels 14, and the like, and performance data delayed by the event delay buffer 44, and sends the retained content to the sound source driver 48.

The sound source driver 48 is an interface that controls the sound source LSI 26 of FIG. 2, and causes digital musical sound generation data to be generated within the range of the maximum number of simultaneously generated sounds, on the basis of input provided from the event buffer 45. In other words, the sound source driver 48 causes musical sounds to be generated on the basis of events that are input in real time by the user via playing keys of the keyboard 11, and events included in automatic performance data to be automatically performed that have been delayed by the event delay buffer 44. In detail, when an automatic performance of the delayed performance data for which performance data has been delayed is to be carried out, the newly required waveform determined by an identifier (a tone color number, a key number, and velocity information) included in the delayed performance data is read from within the RAM 28 in accordance with a timing at which that newly required waveform is to be output. The generated musical sound generation data is output as a musical sound by a sound generation unit 49 constituted by the D/A converter 30, the amplifier 31, and the speakers 16 and 16.

Next, the operation of the embodiment will be described.

First, a description will be given regarding the operation of the large-capacity flash memory 29, which stores all waveform data, and the memory controller 23, which controls the writing of required waveform data that is read from the large-capacity flash memory 29 and the reading of the required waveform data.

In the present embodiment, a sound source is configured from five parts as previously mentioned, and it is possible for five types of tone colors to be generated at the same time.

The tone colors are each configured from a maximum of 32 types of waveform data per one tone color, and the waveform data is stored in the large-capacity flash memory 29. The maximum value of the respective waveform data is 64 kilobytes at most.

Figure 5:
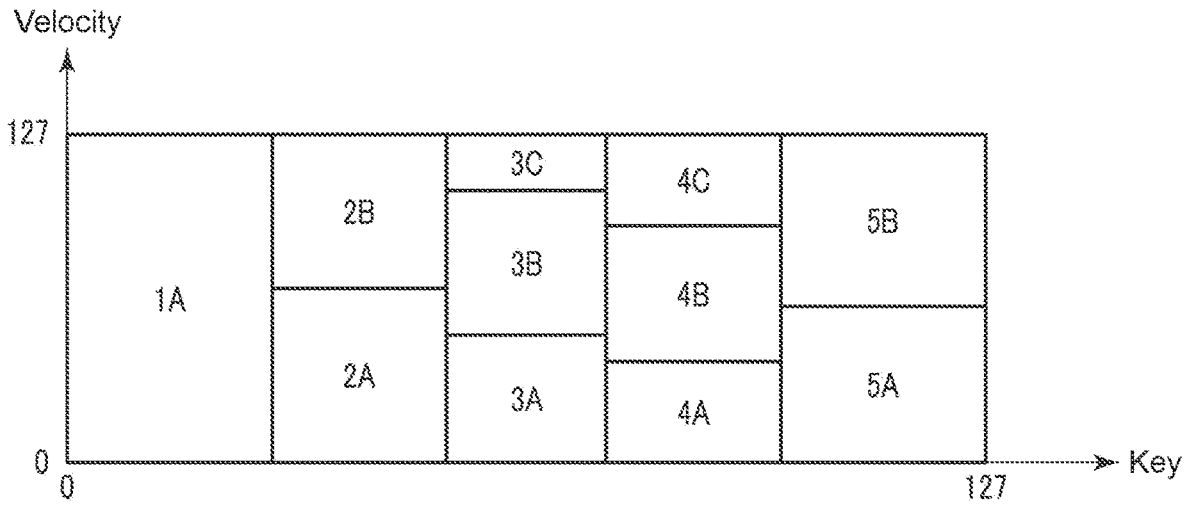
FIG. 5 is a drawing exemplifying a waveform split for tone colors according to the same embodiment.

FIG. 5 is a drawing exemplifying a waveform split for one tone color. As depicted in the same drawing, the band is divided in a two-dimensional manner in accordance with 0 to 127 keys and 0 to 127 velocities, and waveform data is respectively assigned to a maximum of 32 split (divided) areas. In other words, a configuration is adopted in which only one item of waveform data is decided from the two factors of a key that is a key number and a velocity that is the intensity imparted when a key is pressed.

Figure 6:
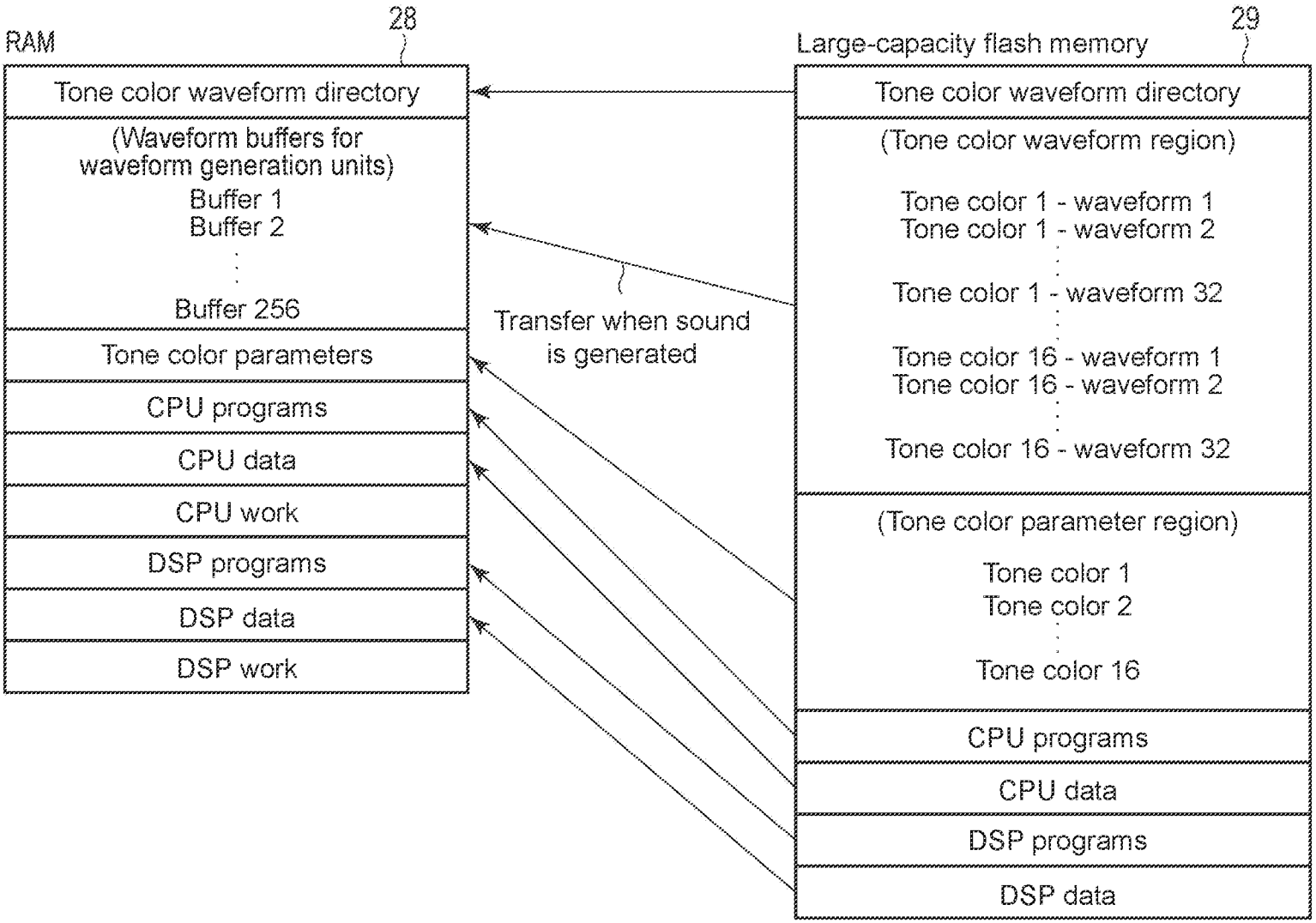
FIG. 6 is a drawing exemplifying the correspondence between content stored in a large-capacity flash memory and content selectively read and retained in a RAM according to the same embodiment.

FIG. 6 is a drawing exemplifying the correspondence between content that is actually stored in the large-capacity flash memory 29 and content that is selectively read and retained in the RAM 28.

The large-capacity flash memory 29 stores a tone color waveform directory, tone color waveform data, tone color parameters, CPU programs, CPU data, DSP programs, and DSP data.

The tone color waveform directory is a table having collected therein, with regard to each tone color, information indicating divided categories of waveform data in terms of key ranges and key stroke velocity ranges, and information indicating addresses and the lengths of the respective the waveform data stored in the large-capacity flash memory 29.

The tone color waveform data has 32 waveforms data for each of the 16 tone colors, for example, and is selectively read by the flash memory controller 24 from a maximum of 512 waveforms.

The tone color parameters are data listing various types of parameters indicating how waveform data is to be handled for each tone color.

The CPU programs are control programs executed by the CPU 22, and the CPU data is fixed data or the like used in the control programs executed by the CPU 22.

The DSP programs are control programs executed by the DSP 26D of the sound source LSI 26, and the DSP data is fixed data or the like used in the control programs executed by the DSP 26D.

The RAM 28 has regions for retaining the tone color waveform directory, waveform buffers for the respective waveform generation units, the tone color parameters, the CPU programs, the CPU data, CPU work, the DSP programs, the DSP data, and DSP work.

In the region for the tone color waveform directory, information regarding key ranges and velocity ranges, by which the waveform data of each tone color is divided, and information regarding addresses, data lengths, and the like of each waveform data within the RAM 28 is retained as a table.

In the region for the waveform buffers for the waveform generation units, waveform data selectively read from the large-capacity flash memory 29 are transferred and retained in buffers respectively assigned to the 256 waveform generation units within the waveform generator 26A of the sound source LSI 26. The waveform data retained in this region is read from the large-capacity flash memory 29 as required at timings at which it has become necessary for a sound to be generated when an automatic performance is being played.

Various types of parameters indicating waveform data for each tone color are retained in the region for the tone color parameters.

Some of the control programs executed by the CPU 22 are read from the large-capacity flash memory 29 and retained in the region for the CPU programs. Fixed data or the like used in the control programs executed by the CPU 22 is retained in the region for the CPU data. In the region for the CPU work, buffers or the like are constituted corresponding to the sequencer 42, the event time generator 43, the event delay buffer 44, the event buffer 45, the required waveform investigation unit 46, the waveform transfer unit 47, and the sound source driver 48 of FIG. 4, and required data or the like is retained therein.

Control programs executed by the DSP 26D of the sound source LSI 26 and fixed data or the like are each read from the large-capacity flash memory 29 and mediated and retained in the regions for the DSP programs and the DSP data. Musical sound generation data or the like that is read from the mixer 26B and subjected to audio processing by the DSP 26D is retained in the region for the DSP work.

Next, key assign processing executed by the CPU 22 will be described. When a key is pressed on the keyboard 11, the CPU 22 executes the key assign processing by which to assign one of waveform generation units within the waveform generator 26A of the sound source LSI 26 to the pressed key number. Here, one of the waveform generation units that had stopped generating a sound is preferentially assigned.

A waveform number is specified from tone color split information that is set at that point in time, and an investigation is carried out as to whether or not a waveform corresponding to the waveform number has been already retained from any of the waveform buffers in the RAM 28.

If the required waveform is not retained in any of the buffers, the required waveform is newly read from the large-capacity flash memory 29 and transferred and stored in a waveform buffer. This new transfer of the new waveform is triggered as a result of the performer operating the keyboard 11 or as a result of the sequencer 42 needing the new waveform. However, it may be that the new waveform transfer has been initiated and the transfer has not been completed. In the latter case where reading has not been completed, the transfer may be midway through being completed, and therefore waiting is carried out until the completion thereof.

Once the waveform data is retained in a buffer of the RAM 28, and the retaining address has been fixed, reading to the waveform generator 26A of the sound source LSI 26 is started for sound generation.

FIG. 7 depicts a directory configuration for data retained in the waveform buffers (for waveform generation units) in the RAM 28. A transfer completion flag, a tone color number, a tone color waveform number, and a waveform size are retained for each buffer number "0" to "255".

The transfer completion flag is a flag indicating whether waveform data has been retained in that buffer, and "1" is set at the point in time at which transfer from the large-capacity flash memory 29 has been completed.

Figure 9:
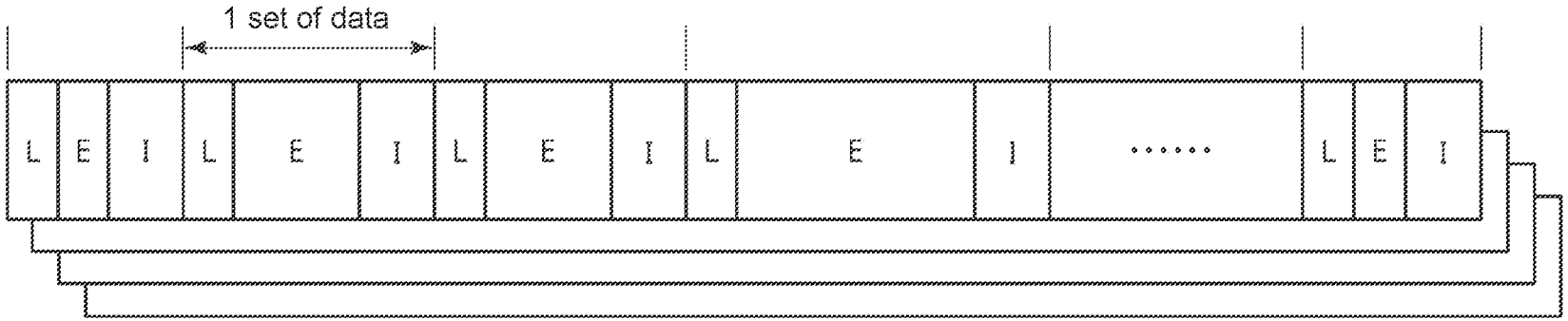
FIG. 9 is a drawing depicting the configuration of sequence data listed and arranged for each track according to the same embodiment.

FIG. 8 is a drawing depicting the format of sequence data recorded in the sequencer 42. As depicted in the drawing, the three fields consisting of an event data length L (LENGTH), event content E (EVENT), and an interval I (INTERVAL) indicating a time interval to the next event serve as one set of data, and a plurality of sets of this data are respectively listed for each track as depicted in FIG. 9.

The event data length L field defines the length of the following event content E, and has a fixed word length of 8 bits and a value range of "0" to "255", and therefore takes a value obtained by subtracting 1 from the actual data length.

The event content E field has a variable word length of 1 byte to 256 bytes, which indicates a control event depicted in FIG. 10 described hereinafter if the first two bytes are "OOH" to "7FH" in hexadecimal, and indicates a MIDI (musical instruments digital interface) event if the first two bytes are "90H" to "FFH".

The interval I field has a fixed length of 16 bits and a value range of "0" to "65535", and expresses the time interval to the next event in units such as ticks obtained by dividing one beat by 480. If the time interval needs to be greater than or equal to "65535" ticks, which is the maximum value for 16 bits, a long period of time is expressed by linking a dummy event(s) using an "NOP" event(s) described hereafter, which are control events, to the extent required.

FIG. 10 is a drawing depicting the formats of control events. They are, for example, an "NOP (non-operation)" event that is used at the beginning of a track or used as a dummy event when 65535 is not sufficient for expressing the interval, an "EOT (end of track)" event arranged at the end of a track, a "TEMPO" event for setting the tempo, and the like.

The "TEMPO" event can be arranged and recognized only in track 1, and is defined by operating a tempo button of the sequencer operation button unit 13 during the recording (sound recording) of track 1. In the "TEMPO" event, resolution is set in 0.1 BPM units, for example.

Figures 11A, 11B:
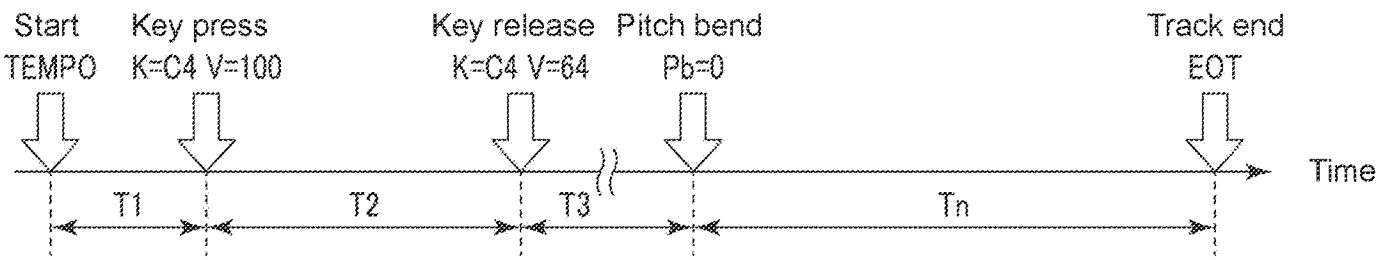
FIG. 11A is a drawing depicting examples of actual event generation timings.
FIG. 11B is examples of specific values for event data corresponding thereto according to the same embodiment.

FIG. 11A is a drawing depicting examples of actual event generation timings, and FIG. 11B is examples of specific values for event data corresponding thereto.

FIG. 11A exemplifies the flow of a series from a TEMPO event at the start, through a key press (NOTE ON) event, a key release (NOTE OFF) event, . . . , and a pitch bend event, to an EOT event at the track end.

In the drawing, K indicates a note number (scale), V indicates a sound intensity, Pb indicates a pitch bend, and T1 to Tn indicate time intervals.

Next, the format configuration of data handled by the event delay buffer 44 will be described using FIG. 12. As previously mentioned, the event delay buffer 44 is a circuit for delaying performance data by a fixed time.

The format configuration for the data handled here, compared to the format configuration for the sequence data depicted in FIG. 8, is a configuration in which a time T field is provided at the head instead of the interval I field, and the three fields consisting of time T, event data length L, and event content E serve as one set of data.

The time T field has a fixed word length of 32 bits and a value range of "OH" to "FFFFFFFFH", and defines a time point at which the event is to be processed.

The following event data length L field and the event content E field have content similar to the sequencer event data depicted in FIG. 8.

Performance data for an automatic performance is delayed by a certain time by the event delay buffer 44. This ensures that there is a sufficient time for the required waveform data to be read from the large-capacity flash memory 29 and transferred and retained in the RAM 28 even if the required waveform data was not present in the RAM 28 initially. Thus, it is possible to avoid the situation where the musical sound of a performance is partially lacking due to the transfer of required waveform data not having been completed by the time of the playback processing for the performance data.

Here, the delay time is, for example, 50 milliseconds, as previously mentioned, and is implemented in accordance with button operations at the sequencer operation button unit 13. The user of the electronic keyboard instrument 10 carries out a performance in accordance with actual audio playback that has been delayed. Therefore, the delay time is not perceived by the user or listeners, and there is no effect whatsoever on the user's performance.

The event time generator 43 is a clock circuit serving as a reference for the delay time, and is configured of a 32-bit free-running timer that returns to OH after a maximum value of FFFFFFFFH. The event time generator 43 increments a clock value one value at a time every 1 millisecond.

The afore-mentioned "ticks" are dependent on the tempo and therefore cannot serve as a reference for the delay time, and therefore, the event delay buffer 44 delays and outputs retained content on the basis of the clock value of the event time generator 43 as previously mentioned.

In the event delay buffer 44, when performance data that is output by the sequencer 42 has been input, the time point T counted by the event time generator 43 is read, and time point information obtained by adding 50, which corresponds to the delay time, to that value is added to the performance data.

In the event delay buffer 44, at the point in time at which time point information added to an event that is waiting at the point of reading matches or has elapsed the clock value of the event time generator 43, the event is read and output to a first event buffer 45.

Hereinafter, the control programs executed by the CPU 22 will be described.

Figure 13:
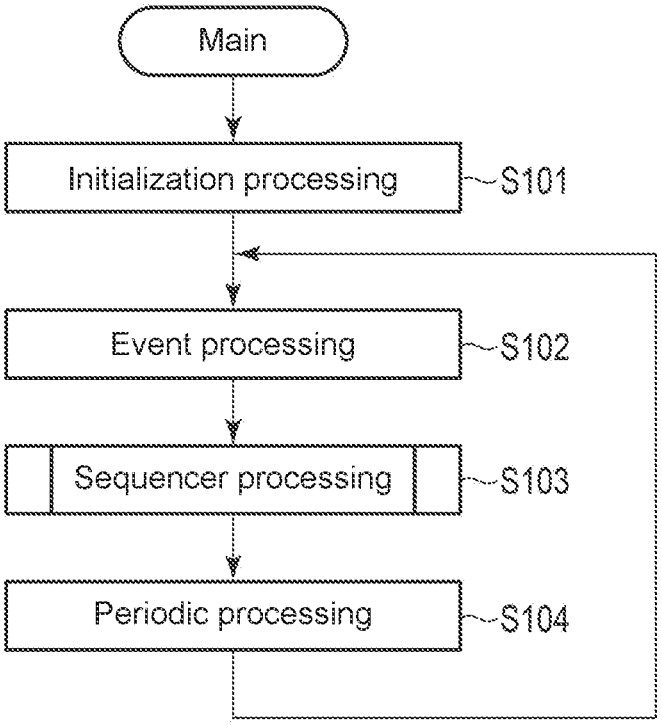
FIG. 13 is a flowchart depicting the processing content of a main routine according to the same embodiment.

FIG. 13 is a flowchart depicting the processing content of a main routine executed by the CPU 22. A power source for the electronic keyboard instrument 10 is powered on for the main routine to be started, and the CPU 22 first initializes each circuit unit (step S101). Processing relating to this initialization includes processing in which the CPU programs, CPU data, DSP programs, and DSP data are read from the large-capacity flash memory 29 and retained in the RAM 28, and then required information of the tone color waveform directory is transferred from the large-capacity flash memory 29 and retained at a designated address in the RAM 28.

After the initialization has been completed, the CPU 22 sequentially and repeatedly executes event processing (step S102) that includes keyboard processing for key press and key release operations in the keyboard 11 or the like and switch processing for button operations in the tone color selection button unit 12 and the sequencer operation button unit 13, sequencer processing (step S103) in which performance data is played or stopped in the sequencer 42, and periodic processing (step S104) that includes delay processing for event data in the event delay buffer 44, processing periodically executed by the required waveform investigation unit 46, and the like.

In a case where there has been a key press event in the keyboard 11 during the event processing in step S102, the CPU 22 generates a keyboard sound generation event that includes a note number corresponding to the location of the keyboard where the key press has been performed and a velocity corresponding to the intensity at the time of the key press, and transmits the generated sound generation event to the event buffer 45.

Similarly, in a case where there has been a key release event in the keyboard 11 during the event processing, the CPU 22 generates a keyboard sound silencing event that includes a note number corresponding to the location of the keyboard where the key release has been performed and a velocity corresponding to the intensity at the time of the key release, and transmits the generated sound silencing event to the event buffer 45.

In a case where an event has been transmitted to the event buffer 45, the sound source driver 48 acquires the event retained in the event buffer 45, and sound generation or sound silencing processing by the sound generation unit 49 including the sound source LSI 26 is executed.

Figure 14:
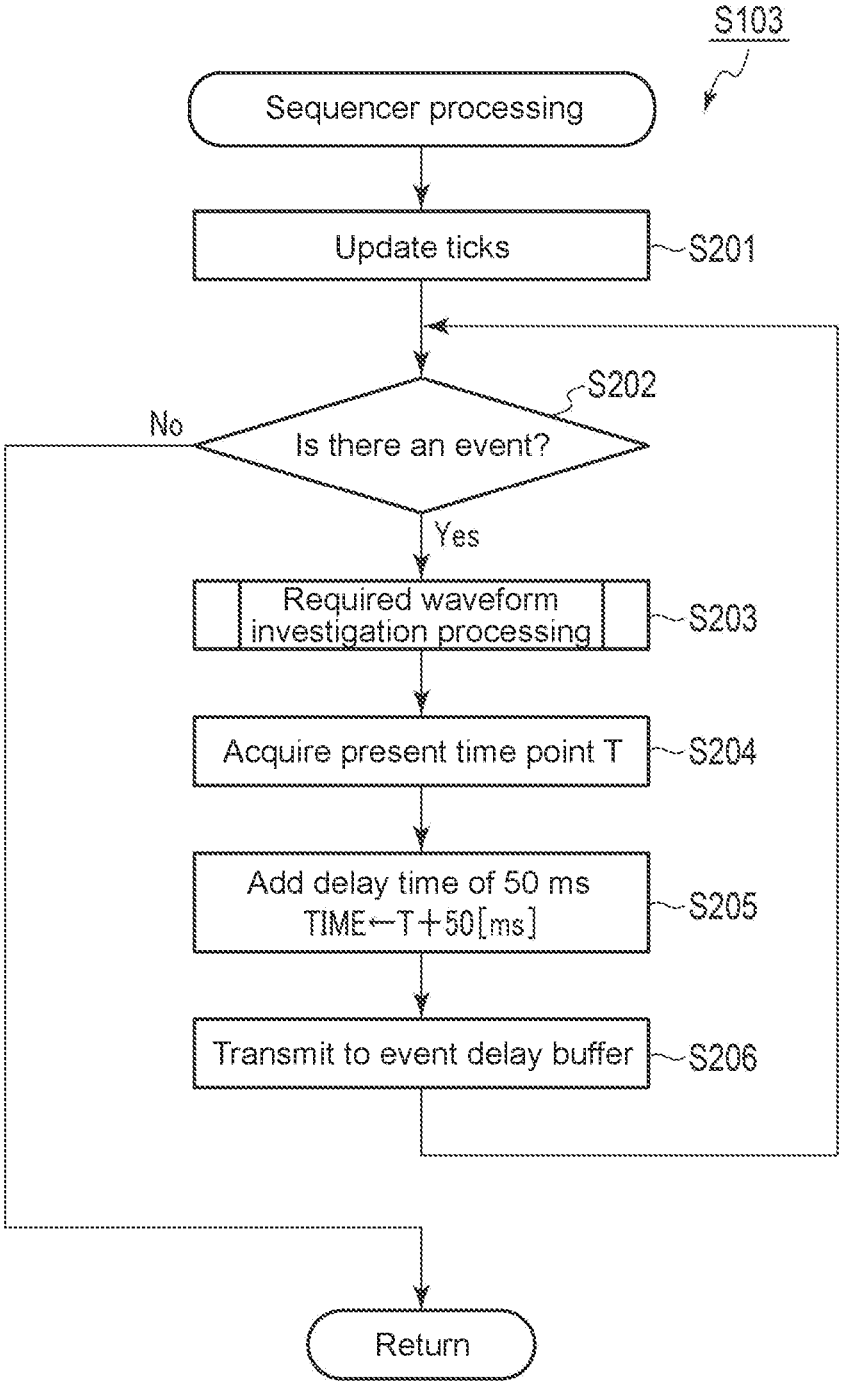
FIG. 14 is a flowchart depicting the processing content of a subroutine carried out during the sequencer processing of FIG. 13 according to the same embodiment.

FIG. 14 is a flowchart of a subroutine carried out during the sequencer playback, executed in the sequencer processing of step S103. The processing of FIG. 14 is activated by the CPU 22 in a case where the performer of the electronic keyboard instrument 10 has pressed play in the sequencer operation button unit 13.

At the beginning of the processing, first, the ticks from the start of playback are updated (step S201), and it is then determined whether or not there is an event to be processed at the updated tick (step S202).

In a case where it is determined that there is an event to be processed ("Yes" in step S202), required waveform investigation processing is executed (step S203), the detailed processing of which will be described hereinafter.

Next, the present time point information T is acquired from the event time generator 43 (step S204).

The CPU 22 adds a time point obtained by adding the fixed delay time of 50 milliseconds to the acquired time point information T, to the event data as the time point TIME of the event (step S205), and then causes this to be transmitted to and retained by the event delay buffer 44 as previously mentioned (step S206).

Thereafter, the CPU 22 returns to the processing from step S202, and repeatedly executes similar processing if there are other events to be processed in the same tick.

In step S202, in a case where it is determined that there are no events or the events to be processed in the same tick have been completed (No in step S202), the CPU 22 ends the processing of FIG. 14.

Figure 15:
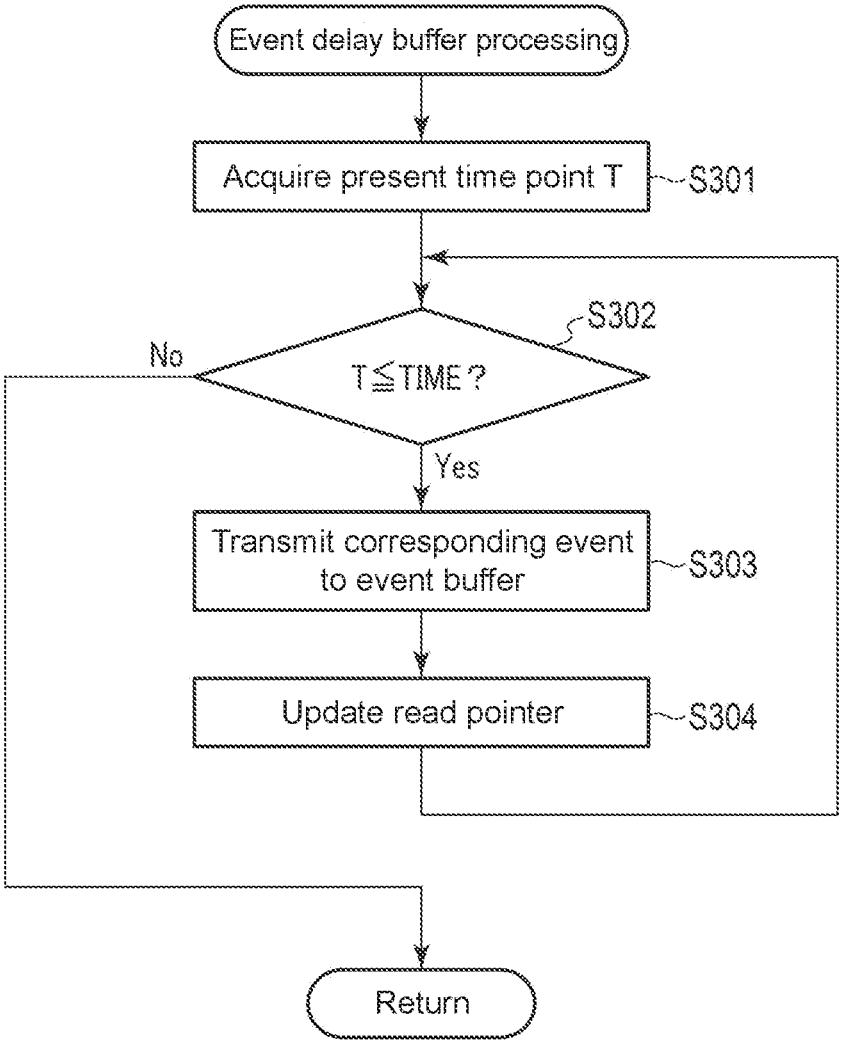
FIG. 15 is a flowchart depicting the processing content of a subroutine executed by the event delay buffer according to the same embodiment.

FIG. 15 is a flowchart of a subroutine depicting processing that is periodically executed by the event delay buffer 44, which retains event data that has been transmitted from the sequencer 42, in step S104 of FIG. 13.

First, the CPU 22 causes the event delay buffer 44 to acquire the present time point information T from the event time generator 43 (step S301).

Next, the CPU 22 acquires time information TIME that has been added to event data indicated by a read pointer for reading the event delay buffer 44, and determines whether or not there is event data to be processed at the timing of that point in time, according to whether or not the acquired time point information TIME is equal to or greater than the present time point information T acquired from the event time generator 43 immediately prior thereto (step S302).

In a case where it is determined that the acquired time point information TIME is equal to or greater than the present time point information T acquired immediately prior thereto (Yes in step S302), the CPU 22 causes the corresponding event data to be read from the event delay buffer 44 and transmitted to the event buffer 45 (step S303).

Next, the CPU 22 implements an update setting proportional to one event for the value of the read pointer (step S304), then once again returns to the processing from step S302, and if there is still other event data to be processed at this timing, similarly causes such event data to be read and transmitted to the first event buffer 45.

Then, in step S302, in a case where it is determined that the time information TIME that has been added to the event data indicated by the read pointer for reading the event delay buffer 44 has not reached the present time point information T, or in a case where it is determined that there is no event data to be read from the event delay buffer 44 (No in step S302), the processing of FIG. 15 is ended.

Figure 16:
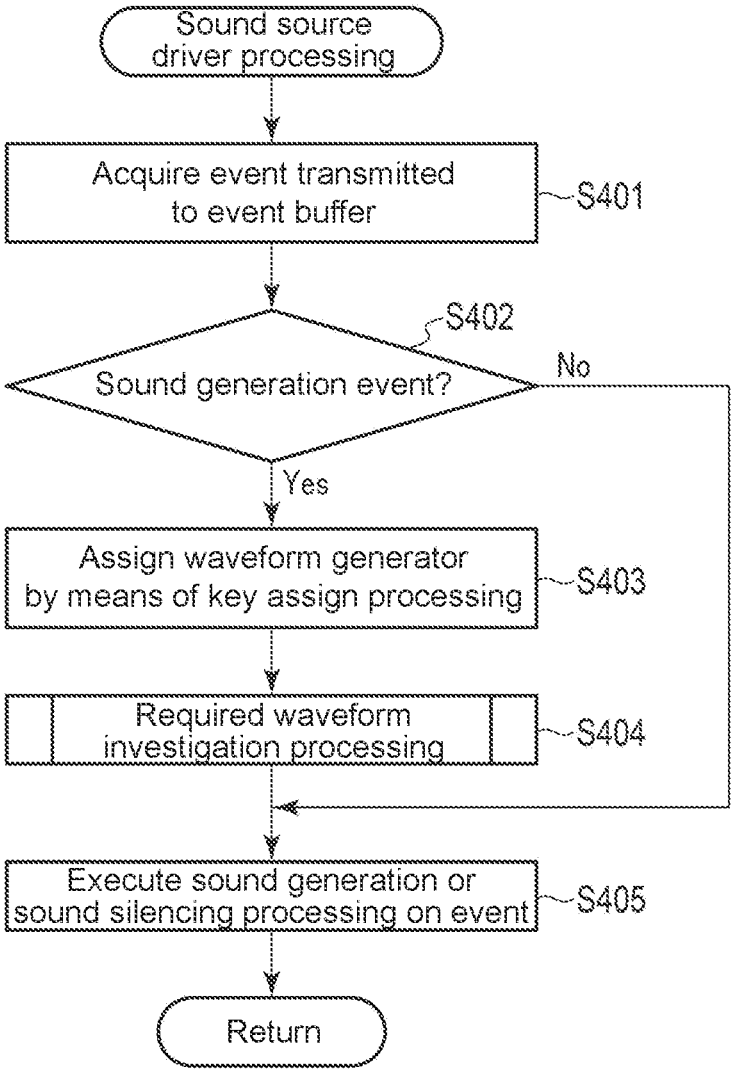
FIG. 16 is a flowchart depicting the processing content of a subroutine executed by a sound source driver according to the same embodiment.

FIG. 16 is a flowchart depicting the processing content of a subroutine that the CPU 22 causes the sound source driver 48 to execute.

At the beginning of the processing, the CPU 22 acquires event data that has been transmitted to the event buffer 45 (step S401). The CPU 22 determines whether or not the acquired event data is a sound generation event (step S402). In a case where it is determined that the event data is a sound generation event (Yes in step S402), the CPU 22 assigns one of the 256 waveform generation units within the waveform generator 26A of the sound source LSI 26 by means of key assign processing (step S403).

Next, the CPU 22 executes required waveform investigation processing, the detailed processing of which will be described hereinafter, to investigate whether or not it is necessary for waveform data used for the sound generation event to be newly read and transferred from the large-capacity flash memory 29 (step S404).

Furthermore, in step S402, in a case where it is determined that the acquired event data is not a sound generation event (No in step S402), the CPU 22 omits the processing of steps S403 and S404.

Thereafter, the CPU 22 executes sound generation or sound silencing processing corresponding to the acquired event data (step S405), and then ends the processing in the sound source driver 48 according to FIG. 16.

Figure 4:
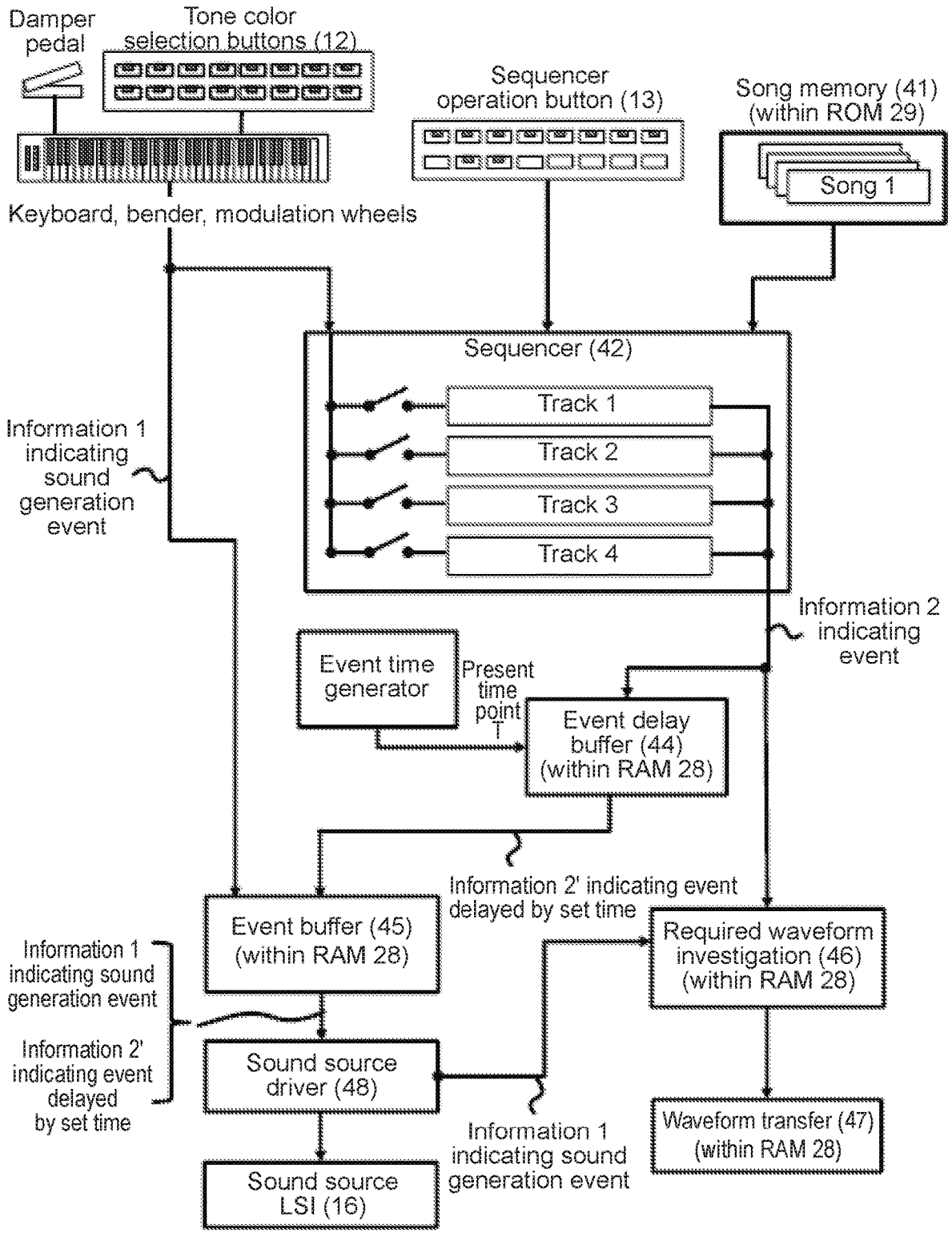
FIG. 4 is a block diagram depicting a functional configuration in terms of data processing according to the same embodiment.
Figure 17:
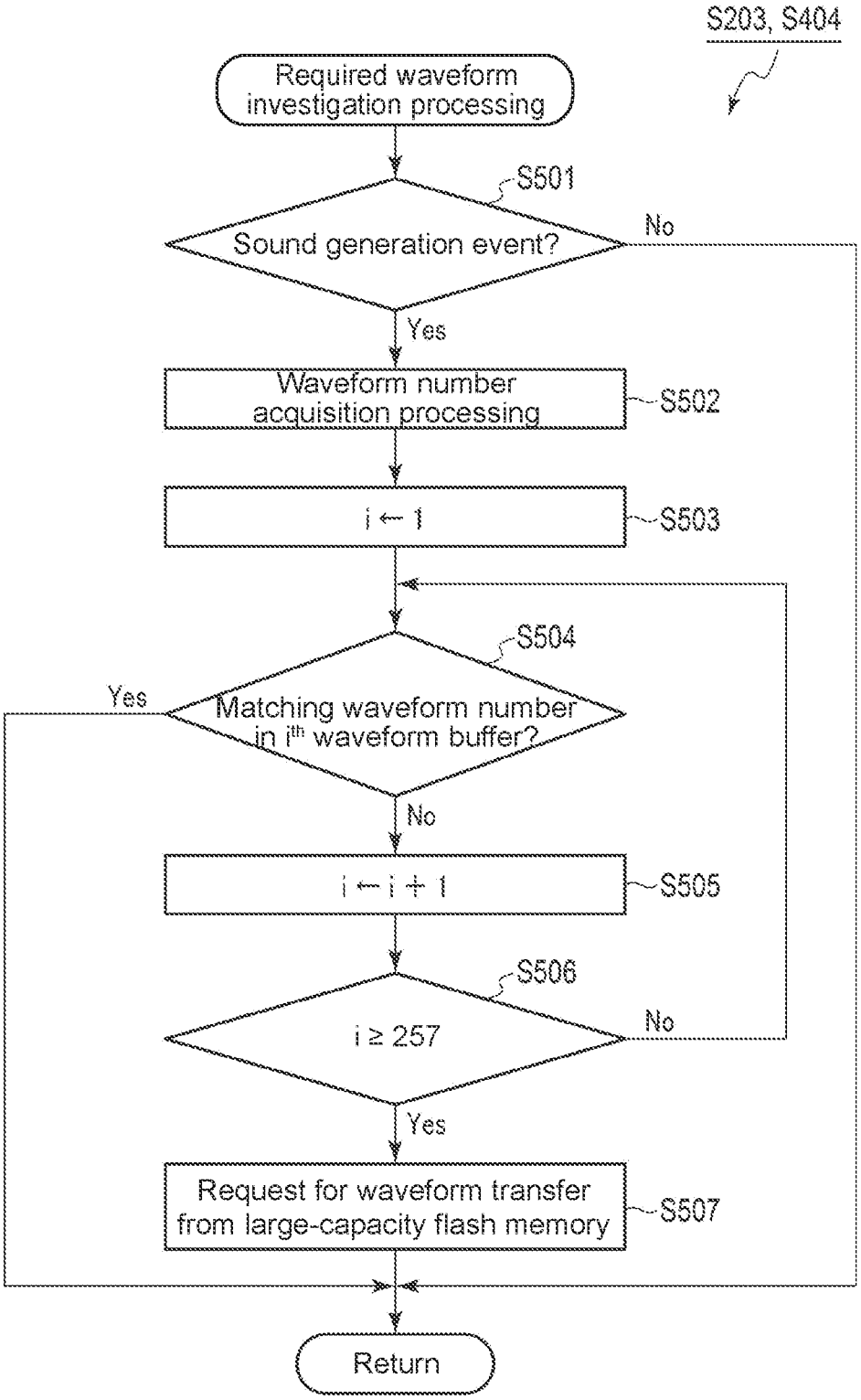
FIG. 17 is a flowchart depicting the processing content of a subroutine of required waveform investigation processing according to the same embodiment.

FIG. 17 is a flowchart depicting the processing content of a subroutine of the required waveform investigation processing in step S203 of FIG. 14 and step S404 of FIG. 16, executed by the required waveform investigation unit 46 of FIG. 4.

At the beginning of the processing, the CPU 22 determines whether or not the generated event is a sound generation event (step S501). In a case where the generated event is not a sound generation event (No in step S501), the CPU 22 ends the processing of FIG. 17.

In step S501, if it is determined that the generated event is a sound generation event (Yes in step S501), the CPU 22 acquires the waveform number(s) of waveform(s) required for the sound generation event (step S502).

Hereinafter, the details of the acquisition of this waveform number will be described.

The CPU 22 acquires a key number and a velocity specified in the received sound generation event, and acquires a tone color number from the CPU work region of the RAM 28. Thereafter, from the head of the table of the tone color waveform directory in the large-capacity flash memory 29, the CPU acquires the waveform number and waveform size in the table with which the tone color number matches, the note number is less than or equal to a maximum key number and greater than or equal to a minimum key number, and the velocity is less than or equal to a maximum velocity and greater than or equal to a minimum velocity, and obtains the address from the head of the corresponding tone color waveform region of the table.

Then, on the basis of those acquired items, the waveform buffers in the RAM 28 are sequentially searched for the waveform having the specified waveform number using a variable i (i=1, 2, . . . , 256), and it is determined whether or not required waveform is already retained in any of the waveform buffers in the RAM 28, according to whether or not there is waveform data having a matching waveform number (step S503 to S506).

In a case where it is determined that waveform data having a matching waveform number is already buffered (Yes in step S504), the CPU 22 ends the processing of FIG. 17 with it being deemed that it is not necessary for required waveform data to be newly transferred from the large-capacity flash memory 29.

Furthermore, in a case where an investigation of the 256th waveform buffer has ended with there being no waveform data having a matching waveform number, and as a result it is determined that required waveform is not retained in the RAM 28 (Yes in step S506), the CPU 22 generates a request for the required waveform to be read and transferred from the large-capacity flash memory 29 (step S507), and then ends the processing of FIG. 17.

Figure 18:
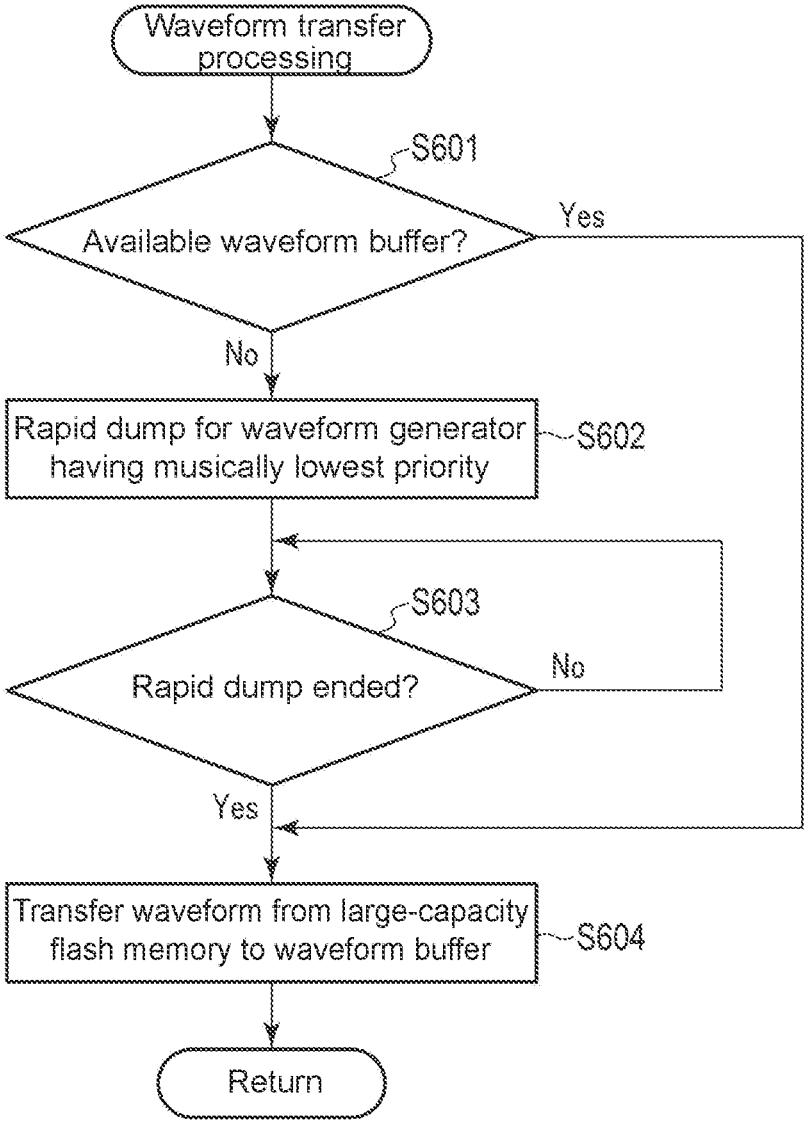
FIG. 18 is a flowchart depicting the processing content of a subroutine of waveform transfer processing according to the same embodiment.

FIG. 18 is a flowchart depicting the processing content of a subroutine of waveform data transfer processing, executed by the CPU 22 on the basis of the aforementioned request. In the function circuit configuration of FIG. 4, the waveform transfer unit 47 executes in accordance with a request from the required waveform investigation unit 46.

First, the CPU 22 determines whether or not at least one of the 256 waveform buffers in the waveform buffer region (for the waveform generation units) in the RAM 28 is available (step S601). In a case where it is determined that there is an available waveform buffer, (Yes in step S601), the CPU 22 reads and transfers required waveform data from the large-capacity flash memory 29 to that available waveform buffer where it is retained (step S604), and then ends the processing of FIG. 18.

Furthermore, in step S601, in a case where it is determined that there is not even one available waveform buffer, (No in step S601), the CPU 22 selects, from among the 256 waveform buffers, one waveform buffer that is retaining waveform data having musically the lowest priority, on the basis of factors including the tone color number, key number region, velocity, and the like, and causes the corresponding waveform generation unit to execute rapid dump processing in which sound generation is rapidly attenuated in a short period of time that does not cause click noise, 2 milliseconds for example, within the waveform generator 26A of the sound source LSI 26 (step S602).

The CPU 22 waits for the rapid dump processing to end in accordance with this processing (step S603). Then, at the point in time at which it is determined that the rapid dump processing has ended, (Yes in step S603), the CPU 22 reads and transfers required waveform data from the large-capacity flash memory 29 to the waveform buffer that had retained the waveform data for which the dump processing was executed, thereby overwriting the waveform buffer with the required waveform data (step S604), and then ends the processing of FIG. 18.

Thus, when the required waveform data need to be read from the large-capacity flash memory 29 and transferred and retained in the RAM 28 during an automatic performance, because waveform data that is to be actually output as a sound during the performance is delayed by the aforementioned fixed time, 50 milliseconds, for example, using the event time generator 43 and the event delay buffer 44, sufficient time can be secured for the transfer of the new waveform data to the RAM 28, thereby allowing the performance to continue without sound break, omissions, or the like.

According to the present embodiment as described in detail above, it becomes possible to smoothly execute the transfer and retention process of additional new waveform data when such new waveform data other than the waveform data that have been already retained for sound source purposes is needed.

Furthermore, in the embodiment, although an automatic performance is delayed by a prescribed time, a delay does not occur in a performance on the keyboard 11 carried out by the user that is accompanied by the automatic performance. Therefore, the performer is able to enjoy performing accompanied by an automatic performance without being aware of the delay time.

Furthermore, when new waveform data needs to be transferred from the large-capacity flash memory 29 to the RAM 28 during the performance, if there is no available waveform buffer where the new waveform data can be transferred and retained in the RAM 28, waveform data that is considered to have musically a low priority and to have the least effect on the entire performance even if silenced from among the waveform data already retained at that point in time is selected, and sound generation for the selected waveform data is then quickly attenuated in a short time span that does not cause click noise; thereafter, the new waveform data is transferred and overwritten in the buffer location where the selected waveform data had been retained. In this manner, waveform data can be transferred without performance content being greatly affected even in a case where the capacity of the RAM 28 that is able to retain waveform data used for the performance is limited.

In the above embodiment, a description was given for the case where the present invention is applied to the electronic keyboard instrument 10 in which the keyboard 11 is used; however, it should be noted that the present invention does not limit the type of the electronic musical instrument or the like, and provided that the electronic musical instrument is capable of automatically playing performance data, it is possible for the present invention to be similarly applied even to various types of synthesizers, tablet terminals, personal computers, or the like including software.

A specific embodiment of the present invention was described above, but the present invention is not limited to the above embodiment, and various alterations can be implemented without deviating from the gist of the present invention. It will be apparent to those skilled in the art that various alterations and modifications can be made in the present invention without departing from the spirit or scope of the present invention. Thus, it is intended that the present invention cover alterations and modifications that come within the scope of the appended claims and their equivalents. In particular, it is explicitly intended that any part or whole of any two or more embodiments and their modifications described above can be combined and regarded as being within the scope of the present invention.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument comprising:

a plurality of playing keys to be operated by a user for generating a real time sound generation event to be outputted from the musical instrument in real time;

a first memory that stores a plurality of waveforms to be used in automatic performance that is outputted by the musical instrument in accordance with automatic performance data so as to accompany the real time sound generation event;

a second memory having faster access speed than the first memory, the second memory including an event buffer for storing data for the real time sound generation event specified by the user operation of the playing keys and data for the automatic performance, the second memory further including a plurality of waveform buffers for retaining data for waveforms to be used in sound production; and at least one processor, wherein the at least one processor performs the following:

causing the automatic performance data to be generated, the automatic performance data including an identifier to specify a waveform used in the automatic performance, data that specifies events included in the automatic performance, and data that indicates a playback timing of each of said events in the automatic performance;

searching the plurality of waveform buffers in the second memory to determine whether any of the plurality of waveform buffers retains the waveform specified by the identifier in the automatic performance data;

if the searching determines that none of the plurality of waveform buffers retain the specified waveform, accessing the first memory, retrieving the specified waveform from the first memory, and causing the specified waveform to be retained in one of the plurality of waveform buffers in the second memory that is available or is caused to be available;

causing the playback timing of each of said events in the automatic performance data to be delayed by a prescribed delay time to generate delayed automatic performance data that include said events with the delayed playback timings, and causing the delayed automatic performance data to be stored in the event buffer, the prescribed delay time being such that the transfer and retention of the specific waveform from the first memory to the second memory are completed during the prescribed delay time; and accessing the event buffer to retrieve said data for the real time sound generation event and said delayed automatic performance data and causing a sound corresponding to the user operation of the playing keys and a sound of the automatic performance to be generated and outputted from the musical instrument in accordance with the retrieved data for the real time sound generation event and the retrieved delayed automatic performance data.

2. The electronic musical instrument according to claim 1, further comprising an event time generator that is a clock circuit that counts the prescribed delay time, wherein the at least one processor causes the event buffer to store the data indicating the events delayed by the prescribed delay time, based on a count value produced by the event time generator.

3. The electronic musical instrument according to claim 2, wherein the at least one processor causes the playback timing of each of said events in the automatic performance data to be delayed by the prescribed delay time by using a region of the second memory as a delay buffer.

4. The electronic musical instrument according to claim 1, wherein the identifier in the automatic performance data includes information on a tone color number, a key number, and a key stroke velocity, and the at least one processor determines a waveform number specifying the waveform used in the automatic performance on the basis of the key number and the key stroke velocity.

5. The electronic musical instrument according to claim 1, Wherein a number of the plurality of waveform buffers in the second memory correspond to a number of sounds that can be generated simultaneously by the musical instrument.

6. A method of sound generation performed by an electronic musical instrument that includes:

a plurality of playing keys to be operated by a user for generating a real time sound generation event to be outputted from the musical instrument in real time;

a first memory that stores a plurality of waveforms to be used in automatic performance that is outputted by the musical instrument in accordance with automatic performance data so as to accompany the real time sound generation event;

a second memory having faster access speed than the first memory, the second memory including an event buffer for storing data for the real time sound generation event specified by the user operation of the playing keys and data for the automatic performance, the second memory further including a plurality of waveform buffers for retaining data for waveforms to be used in sound production; and at least one processor, the method comprising via said at least one processor:

causing the automatic performance data to be generated, the automatic performance data including an identifier to specify a waveform used in the automatic performance, data that specifies events included in the automatic performance, and data that indicates a playback timing of each of said events in the automatic performance;

searching the plurality of waveform buffers in the second memory to determine whether any of the plurality of waveform buffers retains the waveform specified by the identifier in the automatic performance data;

if the searching determines that none of the plurality of waveform buffers retain the specified waveform, accessing the first memory, retrieving the specified waveform from the first memory, and causing the specified waveform to be retained in one of the plurality of waveform buffers in the second memory that is available or is caused to be available;

causing the playback timing of each of said events in the automatic performance data to be delayed by a prescribed delay time to generate delayed automatic performance data that include said events with the delayed playback timings, and causing the delayed automatic performance data to be stored in the event buffer, the prescribed delay time being such that the transfer and retention of the specific waveform from the first memory to the second memory are completed during the prescribed delay time; and accessing the event buffer to retrieve said data for the real time sound generation event and said delayed automatic performance data and causing a sound corresponding to the user operation of the playing keys and a sound of the automatic performance to be generated and outputted from the musical instrument in accordance with the retrieved data for the real time sound generation event and the retrieved delayed automatic performance data.

7. A non-transitory computer-readable storage medium having stored thereon a program executable by at least processor contained in an electronic musical instrument, the electronic musical instrument further including:

a plurality of playing keys to be operated by a user for generating a real time sound generation event to be outputted from the musical instrument in real time;

a first memory that stores a plurality of waveforms to be used in automatic performance that is outputted by the musical instrument in accordance with automatic performance data so as to accompany the real time sound generation event; and a second memory having faster access speed than the first memory, the second memory including an event buffer for storing data for the real time sound generation event specified by the user operation of the playing keys and data for the automatic performance, the second memory further including a plurality of waveform buffers for retaining data for waveforms to be used in sound production, the program causing the at least one processor to perform:

causing the automatic performance data to be generated, the automatic performance data including an identifier to specify a waveform used in the automatic performance, data that specifies events included in the automatic performance, and data that indicates a playback timing of each of said events in the automatic performance;

searching the plurality of waveform buffers in the second memory to determine whether any of the plurality of waveform buffers retains the waveform specified by the identifier in the automatic performance data;

if the searching determines that none of the plurality of waveform buffers retain the specified waveform, accessing the first memory, retrieving the specified waveform from the first memory, and causing the specified waveform to be retained in one of the plurality of waveform buffers in the second memory that is available or is caused to be available;

causing the playback timing of each of said events in the automatic performance data to be delayed by a prescribed delay time to generate delayed automatic performance data that include said events with the delayed playback timings, and causing the delayed automatic performance data to be stored in the event buffer, the prescribed delay time being such that the transfer and retention of the specific waveform from the first memory to the second memory are completed during the prescribed delay time; and accessing the event buffer to retrieve said data for the real time sound generation event and said delayed automatic performance data and causing a sound corresponding to the user operation of the playing keys and a sound of the automatic performance to be generated and outputted from the musical instrument in accordance with the retrieved data for the real time sound generation event and the retrieved delayed automatic performance data.

* * * * *